US007770408B2

(12) United States Patent
Kim et al.

(10) Patent No.: US 7,770,408 B2
(45) Date of Patent: Aug. 10, 2010

(54) ICE SUPPLIER

(75) Inventors: Yong Su Kim, Seoul (KR); Seong Jae Kim, Seoul (KR); Nam Gi Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 235 days.

(21) Appl. No.: 11/951,411

(22) Filed: Dec. 6, 2007

(65) Prior Publication Data

US 2008/0156823 A1 Jul. 3, 2008

(30) Foreign Application Priority Data

Dec. 29, 2006 (KR) ..... 10-2006-0137660

(51) Int. Cl.

| | |
|---|---|
| ***F25C 5/18*** | (2006.01) |
| ***B67D 7/30*** | (2010.01) |
| ***B67D 7/22*** | (2010.01) |
| ***G07F 11/00*** | (2006.01) |

(52) U.S. Cl. ..... 62/344; 222/14; 222/59; 222/63; 221/10

(58) Field of Classification Search ..... 62/344, 62/137; 221/7, 10, 13; 700/236; 222/14, 222/55, 59, 63, 146.6

See application file for complete search history.

(56) References Cited

U.S. PATENT DOCUMENTS

| | | | | |
|---|---|---|---|---|
| 3,640,089 | A | 2/1972 | Frazier | |
| 5,501,367 | A * | 3/1996 | Chigira | 222/55 |
| 6,082,130 | A | 7/2000 | Pastryk et al. | |
| 6,093,312 | A | 7/2000 | Boulter | |
| 6,148,624 | A | 11/2000 | Bishop et al. | |
| 6,314,745 | B1 | 11/2001 | Janke et al. | |
| 6,351,958 | B1 | 3/2002 | Pastryk et al. | |
| 6,442,954 | B1 * | 9/2002 | Shapiro et al. | 62/137 |
| 6,607,096 | B2 * | 8/2003 | Glass et al. | 222/1 |
| 7,188,479 | B2 | 3/2007 | Anselmino et al. | |
| 7,201,005 | B2 | 4/2007 | Voglewede et al. | |
| 2006/0202071 | A1 | 9/2006 | Jung et al. | |
| 2006/0213213 | A1 * | 9/2006 | Chung et al. | 62/344 |
| 2008/0016899 | A1 | 1/2008 | Anselmino et al. | |

FOREIGN PATENT DOCUMENTS

| | | |
|---|---|---|
| JP | 2000130902 | 5/2000 |
| KR | 10-0201408 B1 | 3/1999 |
| KR | 10-0565616 | 3/2006 |
| KR | 10-0577184 | 5/2006 |

OTHER PUBLICATIONS

International Search Report issued in International Application No. PCT/KR2007/005826, mailed Mar. 20, 2008, 2 pages.
Notice of Allowance issued in Korean Application No. 10-2006-0137660, mailed Jun. 19, 2008, 2 pages.
Korean Office Action dated Oct. 23, 2007, for Korean Application No. 10-2006-0137660, (5 pages).

* cited by examiner

*Primary Examiner*—Frantz F. Jules
*Assistant Examiner*—Cassey Bauer
(74) *Attorney, Agent, or Firm*—Fish & Richardson P.C.

(57) ABSTRACT

An ice supplier includes a case configured to store ice from an ice maker. The case includes an outlet and a transfer unit configured to transfer ice pieces in the case to the outlet. A sensor is configured to sense ice pieces passing through the outlet and a controller is configured to control the transfer unit according to input from the sensor.

25 Claims, 10 Drawing Sheets

ICE SUPPLIER

This application claims the benefit of the Korean Patent Application No. 10-2006-0137660, filed on Dec. 29, 2006, which is hereby incorporated by reference as if fully set forth herein.

BACKGROUND

1. Field

The present disclosure relates to an ice supplier configured to allow a user to detect and/or control a quantity or a velocity of ice supplied by the ice supplier.

2. Discussion of the Related Art

An ice supplier is an appliance configured to make ice and supply ice to a user. An ice supplier may be provided as an independent appliance or may be provided in another appliance (e.g., a refrigerator, etc.).

SUMMARY

In one aspect, an appliance includes a dispenser including an ice dispensing chute, and an ice storage bin configured to store ice pieces. The ice storage bin includes an opening configured to communicate with the ice dispensing chute, and an ice flow path extending at least partially from the ice storage bin to an outlet of the dispenser. The appliance also includes a transfer mechanism configured to transfer ice pieces from the ice storage bin along the ice flow path, a sensor configured to sense ice pieces passing along the ice flow path, and a controller. The controller is configured to determine a volume of ice per unit time passing along the ice flow path based on input from the sensor, and control the transfer mechanism based on the determined volume of ice per unit time.

Implementations may include one or more of the following features. For example, the sensor may include a sender positioned at a side of the opening and configured to send a signal, and a receiver positioned at a side of the opening opposite the sender and configured to receive the signal sent from the sender enabling ice pieces passing along the ice flow path to be sensed. The signal may be an Infrared light signal that is at least partially occluded by ice pieces passing along the ice flow path.

The transfer mechanism may include a regulator configured to transfer the ice pieces in the ice storage bin to the opening and along the ice flow path, and a driving mechanism configured to drive the regulator based on a signal received from the controller. The controller may be configured to control velocity of the driving mechanism based on the determined volume of ice per unit time. The controller may be configured to calculate the volume of ice per unit time of ice pieces passing along the ice flow path based on a number of sensed ice pieces per unit time, and control the driving mechanism based on the number of sensed ice pieces per unit time.

In some implementations, the appliance may include an input device configured to receive user input indicating a desired discharge volume of ice per unit time. In these implementations, the controller may configured to compare the determined volume of ice per unit time to the desired volume of ice per unit time, increase a transfer speed of the transfer mechanism conditioned on the determined volume of ice per unit time being less than the desired discharge volume of ice per unit time, and decrease a transfer speed of the transfer mechanism conditioned on the determined volume of ice per unit time being greater than the desired discharge volume of ice per unit time. The controller may control a transfer speed of the transfer mechanism to adjust the volume of ice per unit time passing along the ice flow path such that a difference between the determined volume of ice per unit time and the desired discharge volume of ice per unit time is less than a threshold amount.

The user input indicating the desired discharge volume of ice per unit time may be a number of ice pieces per unit time or may be a selection of one of multiple possible volumes of ice per unit time. The selection of one of multiple possible volumes of ice per unit time may be a selection of one of a slow volume of ice per unit time and a fast volume of ice per unit time.

In some examples, the appliance may include a display device configured to render a user interface showing a volume of ice per unit time based on the determined volume of ice per unit time passing along the ice flow path.

In another aspect, an appliance includes a dispenser including an ice dispensing chute, and an ice storage bin configured to store ice pieces. The ice storage bin includes an opening configured to communicate with the ice dispensing chute, and an ice flow path extending at least partially from the ice storage bin to an outlet of the dispenser. The appliance also includes a transfer mechanism configured to transfer ice pieces from the ice storage bin along the ice flow path, and a sensor configured to sense ice pieces passing along the ice flow path. The sensor includes a plurality of senders each of which is configured to send a signal, and a plurality of receivers each of which is configured to receive a signal from at least one of the plurality of senders. The plurality of senders are positioned such that a spacing between adjacent senders is less than a predetermined amount, and the plurality of receivers are positioned such that a spacing between adjacent receivers is less than the predetermined amount. The appliance further includes a controller configured to control the transfer mechanism based on a result of the sensor.

Implementations may include one or more of the following features. For example, the predetermined amount may be narrower than a width of a typical ice piece. The plurality of senders and the plurality of receivers may be arranged in a plane intersecting the ice flow path. A number of senders equals a number of receivers and the plurality receivers are positioned such that each receiver is positioned across the ice flow path from a respective one of the senders such that a signal received by each receiver from a respective sender intersects the ice flow path.

In some implementations, the appliance may include a first heating element configured to defrost each of the plurality of senders, and a second heating element configured to defrost each of the plurality of receivers. The appliance may include an input device configured to receive user input indicating a desired quantity of ice pieces. The controller may be configured to control, based on the result of the sensor, the transfer mechanism to dispense a number of ice pieces corresponding to the desired quantity of ice pieces. The desired quantity of ice pieces may be a desired number of ice pieces and the controller may be configured to control, based on the result of the sensor, the transfer mechanism to dispense the desired number of ice pieces.

In yet another aspect, an appliance includes a dispenser including an ice dispensing chute, and an ice storage bin configured to store ice pieces. The ice storage bin includes an opening configured to communicate with the ice dispensing chute, and an ice flow path extending at least partially from the ice storage bin to an outlet of the dispenser. The appliance also includes a transfer mechanism configured to transfer ice pieces from the ice storage bin along the ice flow path, and a sensor positioned at the opening of the ice storage bin and configured to sense ice pieces passing through the opening of the ice storage bin and into the ice dispensing chute. The appliance further includes a controller configured to control the transfer mechanism based on input from the sensor.

Implementations may include one or more of the following features. For example, the controller may be configured to determine a volume of ice per unit time passing through the opening of the ice storage bin and into the ice dispensing chute, and control the transfer mechanism based on the determined volume of ice per unit time. In another example, the controller may be configured to determine a number of ice pieces passing through the opening of the ice storage bin and into the ice dispensing chute, and control the transfer mechanism based on the determined number of ice pieces.

In some implementations, the appliance may include an input device configured to receive user input indicating a desired discharge volume of ice per unit time. The controller may be configured to control, based on the input from the sensor, a transfer speed of the transfer mechanism to adjust a volume of ice per unit time passing through the opening of the ice storage bin and into the ice dispensing chute such that a difference between the volume of ice per unit time passing through the opening of the ice storage bin and into the ice dispensing chute and the desired discharge volume of ice per unit time is less than a threshold amount.

In some examples, the appliance may include an input device configured to receive user input indicating a desired quantity of ice pieces. In these examples, the controller may be configured to control, based on the result of the sensor, the transfer mechanism to dispense a number of ice pieces corresponding to the desired quantity of ice pieces.

DETAILED DESCRIPTION

Figure 1:
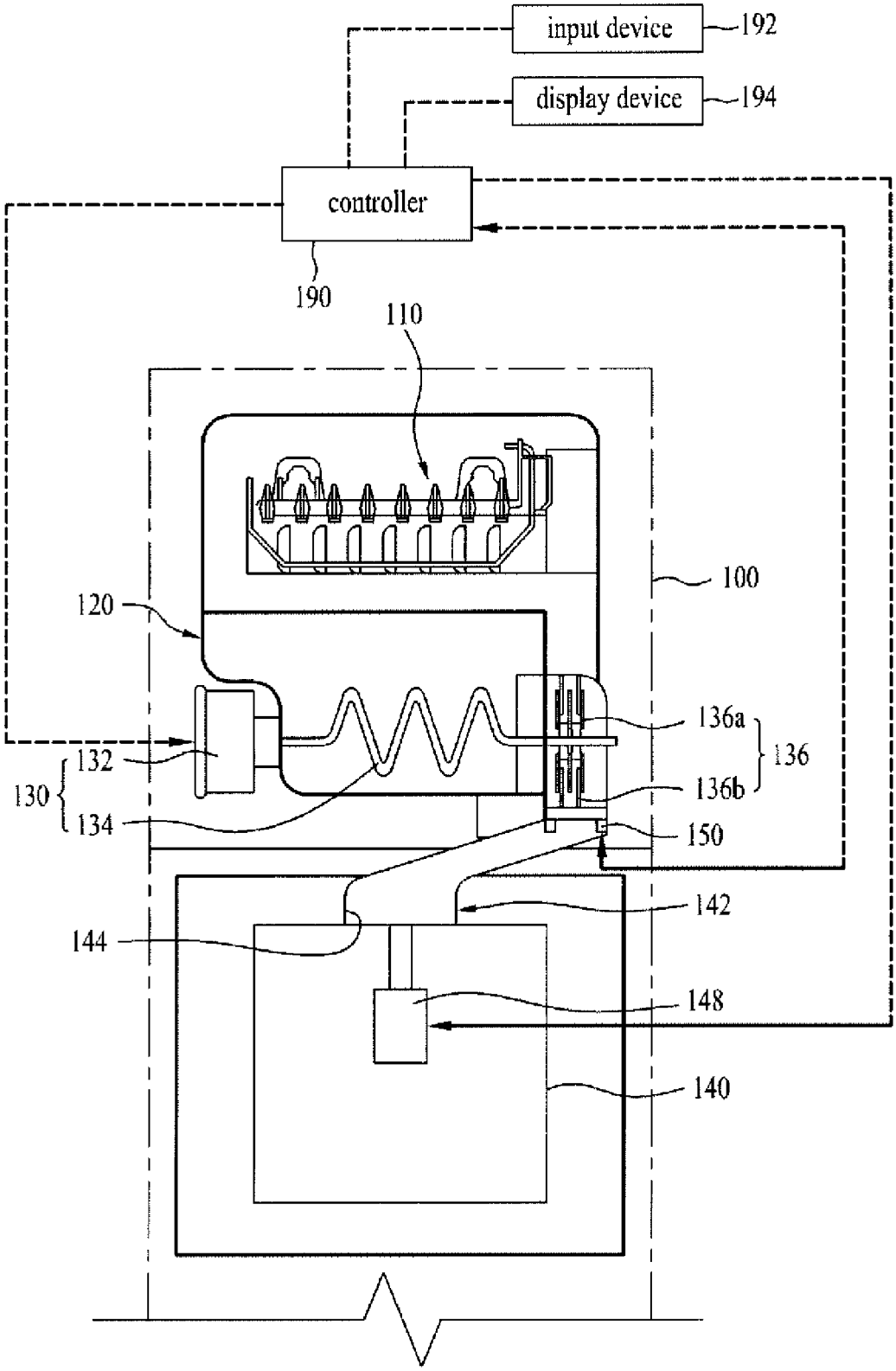
FIG. 1 illustrates an example of an ice supplier.

FIG. 1 illustrates an example of an ice supplier. As shown in FIG. 1, an ice supplier includes a case 120 configured to store ice, a transfer unit 130 configured to transfer ice stored in the case 120, a sensor 150 configured to sense ice being discharged from the case 120, and a controller 190.

The ice supplier may include an ice maker 110 configured to make ice and supply the made ice to the case 120. In some implementations, the ice maker 110 is not required and ice may be manually supplied to the case 120 by a user. In other implementations, the ice maker 110 may be a separate component from the ice supplier.

The ice supplier may be provided as an independent device or appliance, or may be provided in another appliance, for example, a refrigerator. In implementations in which the ice supplier is provided in a refrigerator, the ice supplier may be arranged in a freezer portion or compartment of the refrigerator or in a separate space of a refrigerating portion or compartment of the refrigerator. In the latter example, a temperature of the separate space in the refrigerating portion or compartment of the refrigerator may be regulated to a freezing temperature sufficient to make ice. In some implementations, the ice supplier may be provided in a door of the refrigerator. In other implementations, the ice supplier may be provided in a cabinet of the refrigerator and configured to communicate with a dispenser provided in a door of the refrigerator.

The case 120 may be provided with an opening at one side to receive ice made by the ice maker 110, and may be provided with an outlet at the other side to dispense ice stored in the case 120 through the outlet (e.g., dispense ice made by the ice maker 110 and received through the opening). In some implementations, the ice supplier includes a transfer unit 130 configured to move or transfer ice stored within the case 120. The transfer unit 130 may include a regulator 134 and a driving mechanism 132, wherein the regulator 134 is configured to move or transfer ice stored in the case 120 to the outlet, and the driving mechanism 132 is configured to drive the regulator 134.

The driving mechanism 132 may include a gear connected to a motor and configured to apply a driving force to the regulator 134 in response to being driven (e.g., turned) by the motor. One end of the regulator 134 may be associated with the driving mechanism 132 such that force from the driving mechanism 132 may be applied to the one end. The regulator 134 may be arranged at the base of the case 120 in a screw shape and may be configured to rotate along an axis of the driving mechanism 132 to transfer or move ice in the case 120 to an outlet of the case 120. The transfer unit 130 may include additional or different components configured to move or transfer ice stored in the case 120 to an outlet of the case 120.

In some implementations, a crusher 136 may be provided near an end of the regulator 134 to selectively crush ice transferred by the regulator 134. The crusher 136 may be provided at an end of the regulator 134 opposite of the transfer unit 130 and positioned near the outlet of the case 120. In one example, the crusher 136 includes a fixed blade 136*b* and a rotary blade 136*a* and may be configured to discharge ice transferred by the regulator 134 in either a cubed or uncrushed form or in a crushed form depending on a user's selection.

The sensor 150 may be provided near the outlet to sense the ice being discharged through the outlet.

The driving mechanism 132 of the transfer unit 130 and the sensor 150 may be connected to the controller 190 such that that the controller 190 may be configured to control the driving mechanism 132 based on the sensed result of the sensor 150.

In some implementations, the controller 190 may be configured to measure the discharge time of ice through the outlet using the sensor 150, compare the measured discharge time of ice with a preset or known discharge time of ice to calculate a difference value (e.g., an error value), and control velocity or rotation speed of the driving mechanism 132 to compensate for the difference value.

A geared motor may be used as an example of the driving mechanism 132 to increase or decrease rotation speed, thereby allowing the regulator 134 to control the discharge velocity of ice.

For example, if the time interval is measured while ice is being discharged through the outlet and the measured time interval is longer or shorter than a preset time, the controller may control the discharge velocity of ice through the outlet by controlling the velocity or rotation speed of the driving mechanism 132.

In some implementations, the controller 190 may calculate discharge velocity of ice through the outlet based on a number of pieces (e.g., cubes or crushed pieces) of discharged ice measured through the sensor 150.

For example, the controller 190 may calculate a number of ice pieces discharged per unit time to calculate velocity in a unit of number/unit time. In this example, the controller 190 may compare the calculated velocity with a preset or known discharge velocity of ice to calculate an error value, and control the driving mechanism 132 to compensate for the error value and attain the preset or known discharge velocity.

The controller 190 may compensate for the error value by controlling rotation speed of the driving mechanism 132 (e.g., the geared motor).

In some implementations, the controller 190 may be configured to uniformly maintain the discharge interval (or velocity) of ice, which may enhance the user's satisfaction. For example, if the user desires to discharge ice more quickly or more slowly, the controller 190 may be configured to adapt the discharge interval (or velocity) to the user's desire.

The ice supplier may include an input device 192 configured to enable the user to provide user input related to settings of the ice supplier. The ice supplier may also include a display device 194 configured to render a display of ice supplier settings and status of ice supplier operation to the user.

In some examples, a user may input a quantity of ice to discharge (e.g., a number of ice pieces or cubes, a volume of ice, a mass or weight of ice, or other quantity measurement). In some implementations, the user may input a discharge velocity of ice through the outlet using the input device 192. The display device 194 may be configured to render a display of operational settings of the ice supplier (e.g., a setting of discharge quantity or velocity of ice) or a current operating status or result of the ice supplier (e.g., an actual measurement of discharge quantity or velocity of ice).

In implementations in which the user inputs a desired number of ice pieces using the input device 192, the sensor 150 may count the number of ice pieces discharged through the outlet. In these implementations, the controller 190 may be configured to compare the counted number of ice pieces with the user's input value and drive the driving mechanism 132 until the counted number of discharged ice pieces reaches the input value.

In implementations in which a user inputs the desired discharge velocity of ice through the outlet using the input device 192, the sensor 150 may count the number of ice pieces discharged through the outlet for a discharge time. In these implementations, the controller 190 may be configured to control the driving mechanism 132 to increase or decrease the velocity of ice discharged such that the measured result approximates or matches the user's input value.

In some examples, the driving mechanism 132 may be driven to dispense ice directly in response to a user providing user input to the input device 192. For example, the driving mechanism 132 may be driven to dispense a specified quantity of ice in response to the user entering a desired quantity of ice or the driving mechanism 132 may be driven to dispense ice at a specified velocity in response to the user entering a desired discharge velocity of ice using the input device 192. In some implementations, a separate switching device may be provided to provide user control of dispensing ice. In some examples, the separate switching device may control dispensing based on input to the switching device regardless of the user's input through the input device 192. In these examples, providing input to the separate switching device may control dispensing of ice when the separate switching device is activated without considering a setting of a quantity of ice to discharge or a setting of a velocity with which to discharge ice. In other examples, the separate switching may control dispensing of ice in accordance with settings related to a quantity of ice or a velocity with which to discharge ice. In one example, a single activation of the switching device may control the ice supplier to dispense the set quantity of ice regardless of whether the switching device remains activated (e.g., a single press of the separate switching device causes the set quantity of ice to be dispensed even if the separate switching device is released during dispensing). In another example, the switching device may control the ice supplier to dispense the set quantity of ice if the separate switching device is pressed and held, but control the ice supplier to stop dispensing if the separate switching device is released. In this example, if a user presses and holds the separate switching device, ice is dispensed until the set quantity has been dispensed and then dispensing is stopped. If the user presses the separate switching device and releases the separate switching device prior to the set quantity being dispensed, the release of the separate switching device controls dispensing to stop even if the set quantity of ice has not been dispensed. In some implementations, the separate switching device may be configured to control ice dispensing in accordance with the set velocity with which to discharge ice. For example, activation of the separate switching device may result in dispensing of ice at the set velocity. In other implementations, the separate switching is not configured to control ice dispensing in accordance with the set velocity with which to discharge ice. For example, activation of the separate switching device may result in dispensing of ice at a default or predetermined velocity without regard for the setting (e.g., the default or predetermined velocity may be higher, slower, or equal to the set velocity).

Referring to FIG. 1, an example of the separate switching device includes a switching device included in a dispenser. For example, a user may input a desired number of ice pieces or a desired velocity of ice to discharge through the outlet using the input device 192 and then push a lever 148 by using a cup to discharge ice based on the input value.

Although the lever 148 may be the separate switching device, as shown in FIG. 1, a separate sensor 150 may be provided to automatically sense that a user requests discharge of ice, thereby enabling discharge of ice based on the input value. Alternatively, a button type (or any other type) switching device may be provided instead of the lever.

Figure 2:
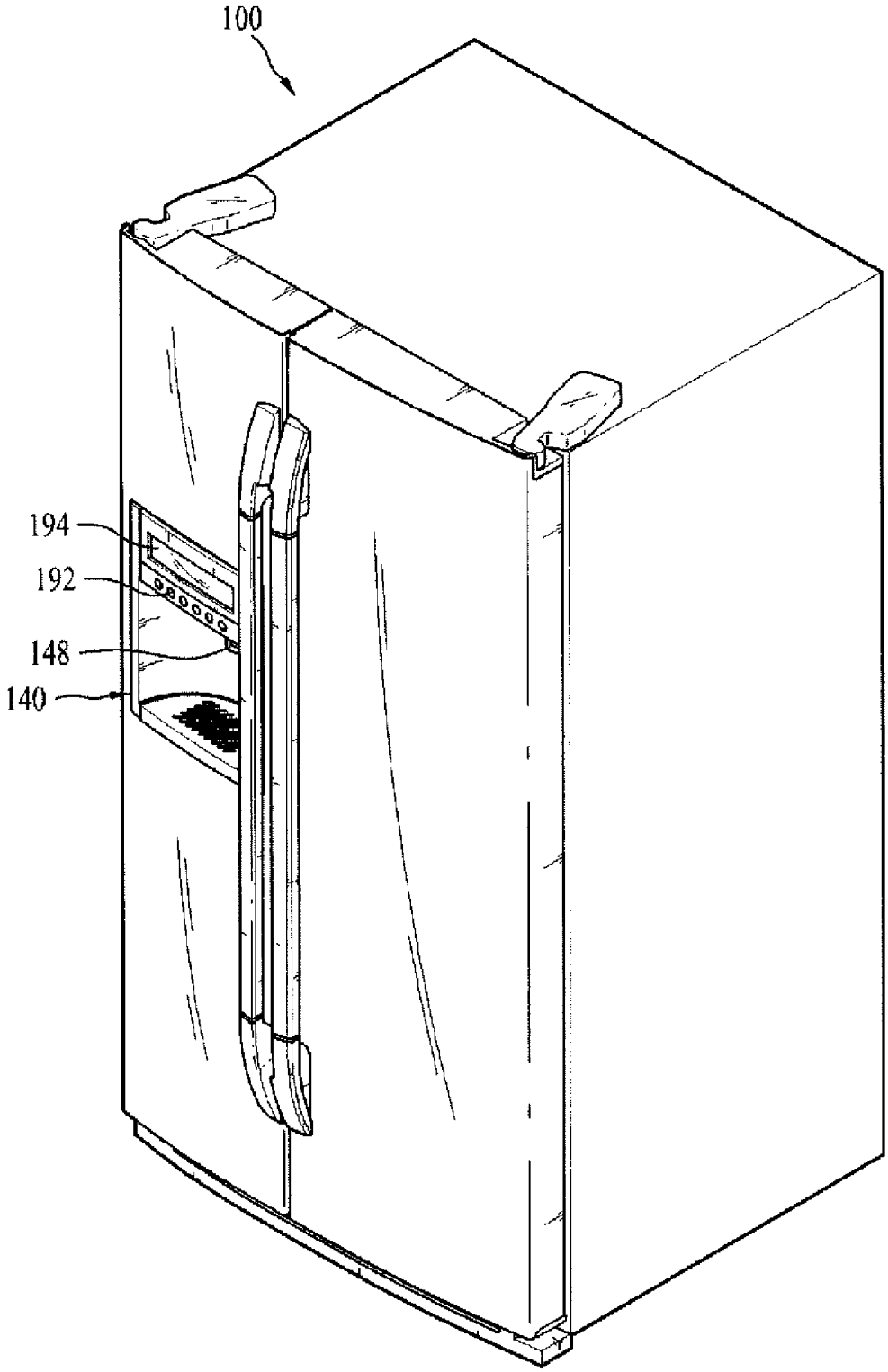
FIG. 2 illustrates an example of a refrigerator that includes an ice supplier.

FIG. 2 illustrates an example of a refrigerator 100 that includes an ice supplier. The refrigerator 100 includes an ice supplier, such as the ice supplier described with respect to FIG. 1.

Although FIG. 2 illustrates that the ice supplier is provided in a door of the refrigerator 100, the ice supplier may be provided in other locations of the refrigerator 100. For example, the ice supplier may be provided inside the refrigerator 100 in a freezing compartment.

The refrigerator 100 includes the input device 192 and the display device 194 as described above with respect to FIG. 1. The input device 192 and the display device 194 may be part of the ice supplier or may be separate components. As shown in FIG. 2, the input device 192 and the display device 194 may be provided outside the refrigerator so that the user may easily access them.

Figure 3:
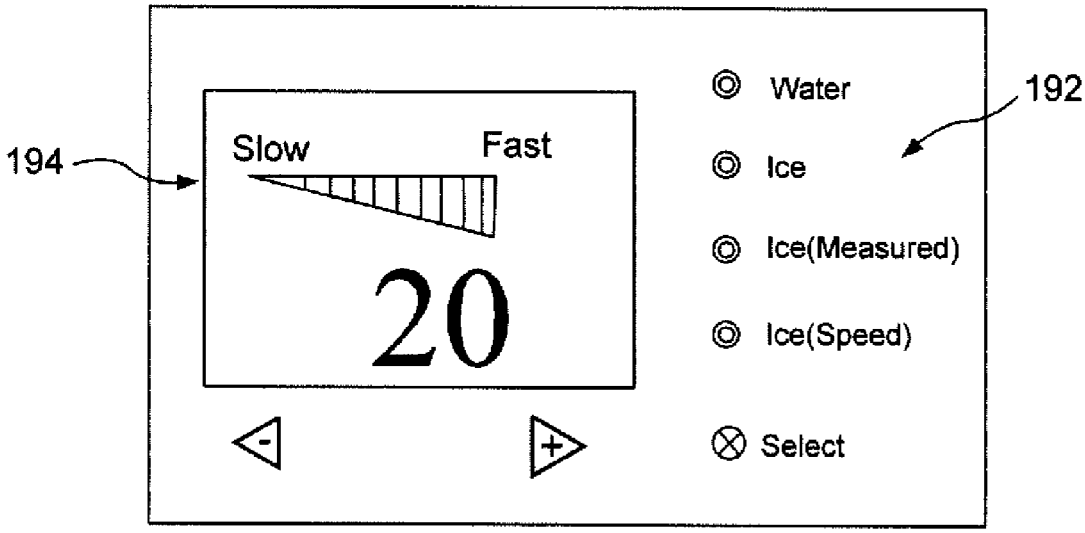
FIG. 3 illustrates an example of an input device and a display device of a refrigerator or an ice supplier.

Referring to FIG. 3, an example of the input device 192 and the display device 194 is shown as being provided in the refrigerator 100 including the ice supplier. As shown, the input device 192 and the display device 194 may be provided in a single display panel. In other implementations, the input device 192 and the display device 194 may be provided separately.

The display panel may be provided with controls such as "Water" to control a water function, Ice to control a normal ice function, Ice (Measured) to control an ice quantity control function, and Ice (Speed) to control an ice speed or velocity control function. The display panel may also be provided with a select key to select any one of the four functions.

The display device 194 is configured to display information related to a discharge velocity of ice and the discharged number of ice pieces. The display device 194 may be provided with a plus key and a minus key.

The water function control is configured to allow the controller 190 to stop actuation of the ice supplier and allow a water supplier provided in the refrigerator to supply water in response to a user's request.

The normal function control is configured to allow the controller 190 to stop actuation of the water supplier and allow the ice supplier to supply ice in response to a user's request. In implementations in which the normal function control is activated, ice is discharged according to a preset condition of the controller 190 in response to a request for ice by a user (e.g., actuating the lever 148).

In implementations in which the normal function control is activated, the controller 190 may be configured to control the driving mechanism 132 to uniformly maintain the discharge interval of ice or uniformly control the discharge velocity of ice.

The number control function is configured to allow a user to input the user's desired number of ice pieces and discharge a number of ice pieces equivalent to the input number of ice pieces.

For example, if the user selects the Ice (Measured) control, a default number of ice pieces is displayed in the display device 194. Alternatively, a number of ice pieces, previously input by a user may be displayed.

If a user desires more than the number of ice pieces displayed in the display device 194, the user may push a plus button to increase the number of ice pieces. If the user desires less than the number of ice pieces displayed in the display device 194, the user may push a minus button to decrease the number of ice pieces.

For example, the number of ice pieces displayed in the display device 194 is increased or decreased depending on a push of the plus button or the minus button.

After inputting the input value as above, if the user actuates the lever 148 (see FIG. 1), the controller 190 controls the driving mechanism 132 to discharge a number of ice pieces equivalent to the input number of ice pieces. In this implementation, the sensor 150 senses the actual number of discharged ice pieces. The controller 190 is configured to compare the sensed number of ice pieces with the input number of ice pieces and drive the driving mechanism 132 until the sensed number of ice pieces becomes equal to the input number of ice pieces.

If the number of ice pieces displayed in the display device 194 continues to be decreased and reaches zero, the controller 190 stops actuation of the driving mechanism 132 so that no ice is discharged.

If the user stops actuation of the lever while ice is being discharged, the controller 190 may be configured to stop actuation of the driving mechanism 132 so as not to discharge ice even if ice to be discharged physically remains or the set quantity of ice has not been discharged. If the user actuates the lever again, ice equivalent to the number of ice pieces in the set quantity which have not been discharged may be discharged until zero is displayed (e.g., ice is discharged until all of the remaining set quantity has been discharged).

In some implementations, the speed control function is configured to allow a user to input the user's desired velocity of ice being discharged. In these implementations, the ice supplier may be configured to discharge ice based on the input velocity.

For example, if a user selects the Ice (Speed) control, a default velocity of ice discharge may be displayed in the display device 194. Alternatively, a velocity of ice discharge previously input by the user may be displayed.

If a user desires ice discharge at a discharge velocity higher than the displayed velocity, the user may push the plus button to increase the discharge velocity of ice. If the user desires ice discharge at a discharge velocity lower than the displayed velocity of ice, the user may push the minus button to decrease the discharge velocity of ice.

In some implementations, the controller 194 may be configured to control the velocity or rotation speed of the driving mechanism 132 to allow the regulator 134 to increase or decrease the discharge velocity of ice.

Figure 4:
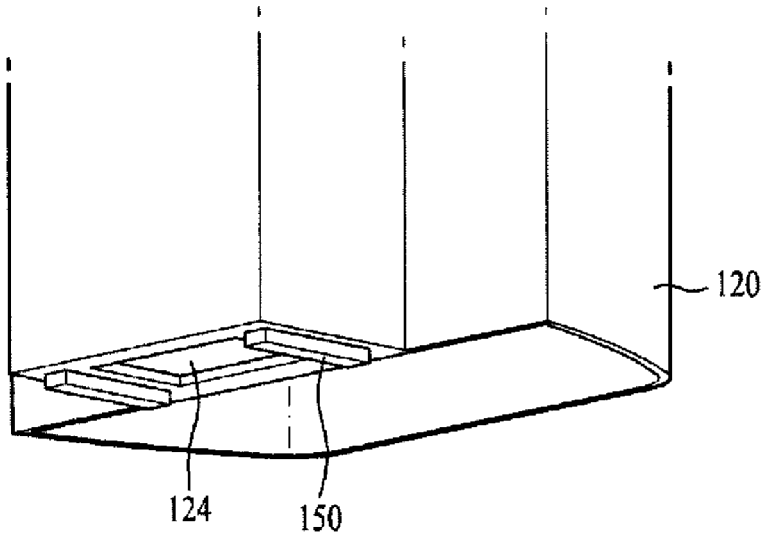
FIG. 4 and FIG. 5 illustrate an example of a sensor provided in an ice supplier.

FIG. 4 illustrates an example of a sensor provided in an ice supplier. The sensor 150 may be installed in a variety of locations on an ice discharge path of the ice supplier. For example, the sensor 150 may be provided on a lower side of the outlet 124 of the case 120, a passage 142 (see FIG. 1) which guides ice discharged from the outlet 124 of the case 120 to the dispenser 140 (see FIG. 1), or another part of the path of ice discharged from the case 120 to the user's container.

Figure 5:
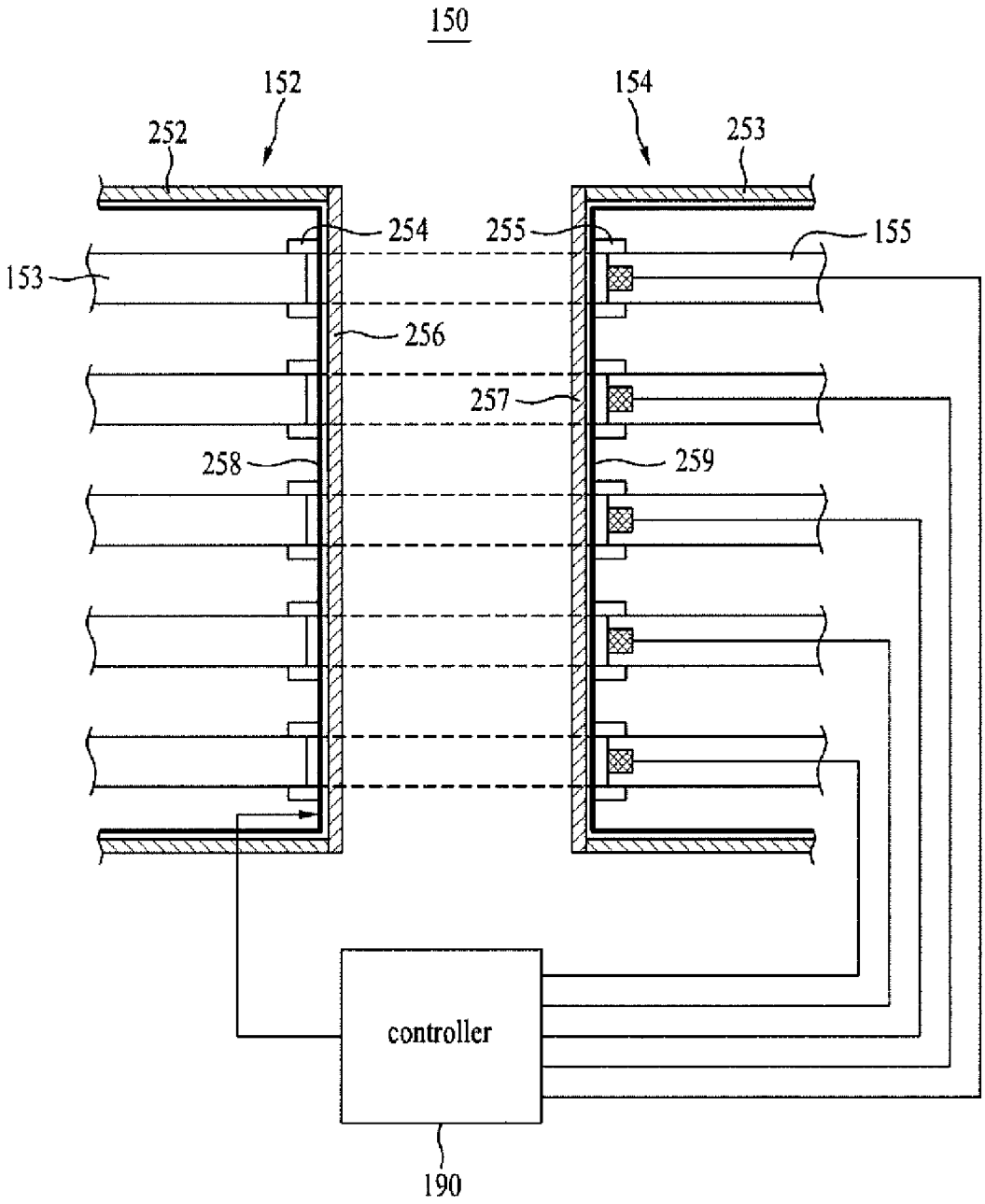

FIG. 5 illustrates an example of a sensor provided in an ice supplier. As shown in FIG. 5, the sensor 150 includes a sending part 152 and a receiving part 154. The sending part 152 may be configured to send or emit a predetermined signal or a light signal and the receiving part 154 may be configured to receive the signal or light sent or emitted from the sending part 152.

Ice passing through the space between the sending part 152 and the receiving part 154 may cut off the signal or light when ice is discharged. When an ice piece cuts off the signal or light, an off signal may be generated and the controller 190 may receive the off signal and determine that an ice piece has passed through the portion of the discharge path associated with the sensor 150.

In some implementations, the receiving part 154 may be configured to sense the intensity of the signal or light sent from the sending part 152. In these implementations, the receiving part 154 may be configured to generate an off signal when the receiving part 154 receives a signal or light having no certain intensity.

Each receiver may include a detector to sense the intensity of the signal or light.

As shown in FIG. 5, the sending part 152 includes a plurality of senders 153 configured to send or emit a signal or light. The receiving part 154 includes a plurality of receivers 155 configured to receive the signal or light. The receiving part 154 may include a receiver 155 corresponding to and positioned opposite of each sender 153 included in the sending part 152.

The sending part 152 may include a body 252, a fixing part 254 configured to attach the senders 153 to the body 252, and a transparent window 256 formed to cover the senders 153 on a side in which the senders 153 send or emit the signal or light.

The receiving part 154 may include a body 253, a fixing part 255 configured to attach the receivers 155 to the body 253, and a transparent window 257 formed to cover the receivers 155 on a side in which the receivers 155 receive the signal or light.

In some implementations, a plurality of fixing parts 254 and 255 may be formed in the bodies 252 and 253, and a sender 153 and receiver 155 pair may be fixed to respective pairs of fixing parts 254 and 255. The transparent windows 256 and 257 may be disposed on the front of the sender 153 and the receiver 155 to provide physical protection to the sender 153 and the receiver 155 while enabling passage of the signal or light sent or emitted from the sender 153 to the receiver 155.

Each of the plurality of senders 153 and each of the plurality of the receivers 155 may be arranged at predetermined distance or spacing between adjacent senders 153 and adjacent receivers 155. In this example, the senders 153 and the receivers 155 may be arranged such that the predetermined distance or spacing is less than the minimum width of a typical ice piece.

By such an arrangement, discharge of a typical ice piece may be sensed because the typical ice piece will pass through at least one signal based on the size of the distance or space between adjacent senders and receivers.

Because the sensor 150 is used in the ice supplier, the sensor 150 is subject to operation at a very low temperature. Operation at a low temperature may cause the temperature difference between heat generated from each sender 153 and each receiver 155 and a peripheral low temperature, whereby frost occurs in each sender 153 and each receiver 155 or each of the windows 256 and 257.

If frost occurs, an intensity of the signal or light sent or emitted from the sender 153 may become weak and the signal or light received in the receiver 155 may also become weak. Consequently, performance of the sensor 150 may be negatively impacted such that an off signal may improperly output from a receiver 155 when ice is not being discharged.

Accordingly, the sending part 152 includes a first heating element 258 configured to defrost the senders 153, and the receiving part 154 includes a second heating element 259 configured to defrost the receivers 155.

Although FIG. 5 illustrates that each heating element is positioned to cover all the senders 153 and all the receivers 155, other arrangements may be used and multiple heating elements may be provided (e.g., one for each of the senders 153 and the receivers 155).

The controller 190 may be connected with each detector of the receivers 155, the first heating element 258 and the second heating element 258. The controller 190 may be configured to control the first heating element 258 and the second heating element 259.

For example, the controller 190 detects a signal through each detector. If the intensity of the signal or light detected by the detector becomes weak even in case of no discharge of ice, the controller 190 turns on the first heating element 258 and the second heating element 259.

The signal or light transmitted between the senders 153 and receivers 155 may include any possible signal that is capable of detecting presence or absence of ice. For example, the signal may be one of an ultrasonic wave, infrared ray, and laser.

In some implementations, the controller 190 may substantially and uniformly maintain a discharge interval and discharge velocity of ice.

For example, when ice is discharged, the sensor 150 may sense a time interval between discharged ice pieces, and the controller 190 may determine whether the time interval is within a range of a preset time interval.

If the time interval is not within the range of the preset time interval, the controller 190 may be configured to control velocity or rotation speed of the driving mechanism to uniformly discharge ice at the preset time interval.

Alternatively, the controller 190 may be configured to compare the sensed time interval with a predetermined set time and control the driving mechanism to cause an error value corresponding to the difference between the sensed time interval and the predetermined set time to reach zero (0).

The sensor 150 may be configured to sense the number of discharged ice pieces, and the controller 190 may be configured to calculate discharge velocity of ice based on the sensed result and determine whether the calculated velocity of ice is within a range of preset discharge velocity of ice.

If the calculated velocity of ice is not within the range of preset discharge velocity of ice, the controller 190 may be configured to control the driving mechanism to cause the discharge velocity of ice to be within the range of the preset discharge velocity of ice.

In some implementations, the controller 190 may be configured to compare the calculated discharge velocity of ice with a predetermined set velocity and control the driving mechanism to cause an error value corresponding to the difference between the calculated discharge velocity and the predetermined set velocity to reach zero (0).

Figure 6:
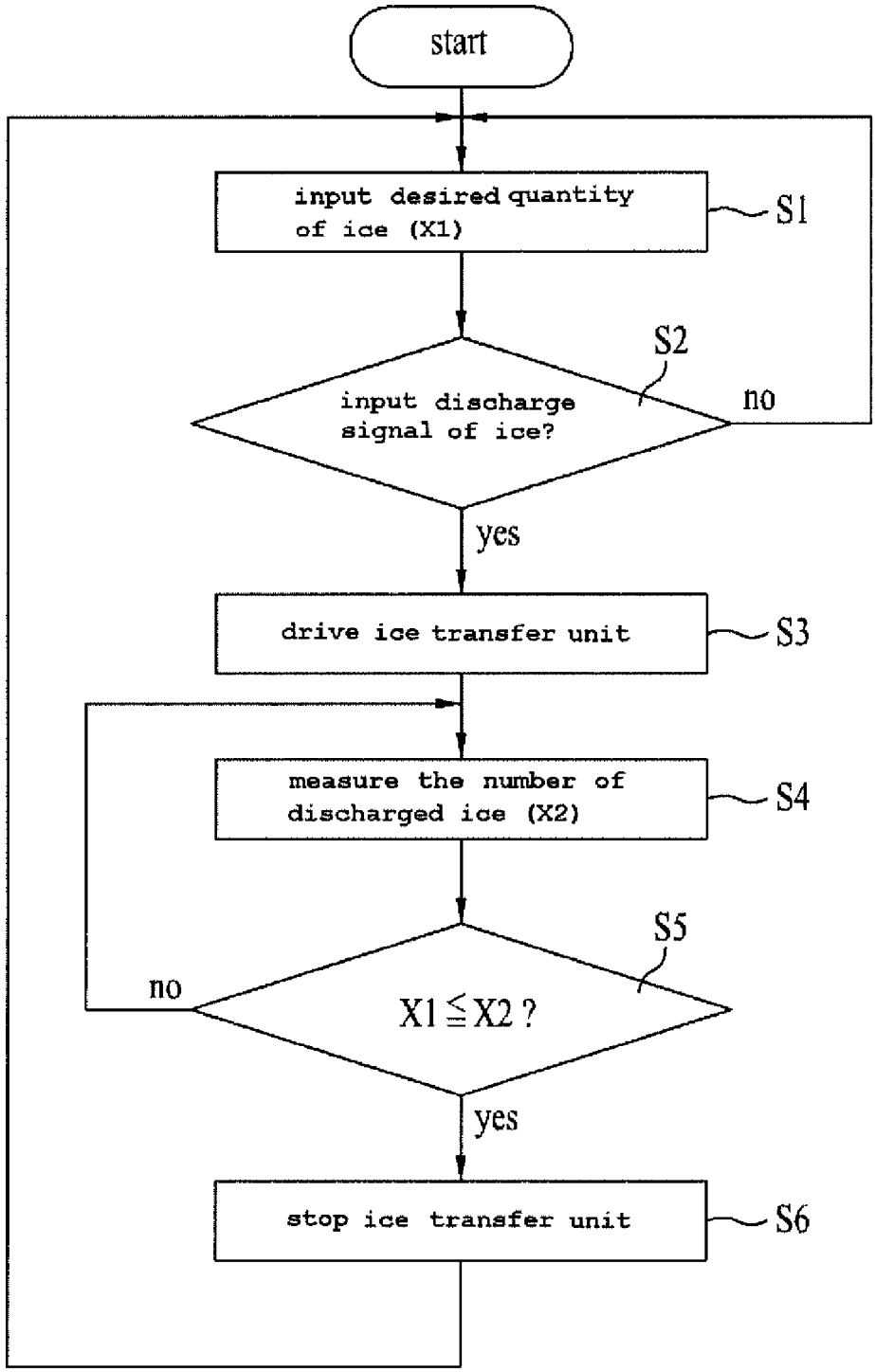
FIG. 6 is a flow chart illustrating an example of a process for supplying a desired quantity of ice.

FIG. 6 illustrates an example of a process for supplying a desired quantity of ice. For convenience, particular components described with respect to FIGS. 1-5 are referenced as performing the process. However, similar methodologies may be applied in other implementations where different components are used to define the structure of the system, or where the functionality is distributed differently among the components shown by FIGS. 1-5.

The input device 192 receives user input indicating a desired quantity of ice to dispense (S1). For example, the input device 192 may receive user input indicating a particular number of ice pieces to dispense or user input indicating any measure of quantity (e.g., volume, mass, etc.). The input device 192 may transmit the desired quantity of ice input by the user to the controller 190. The controller 190 may establish the inputted desired quantity of ice as a set quantity and control dispensing based on the set quantity.

The controller 190 determines whether an input signal configured to control discharge of ice has been received (S2). For example, the controller 190 determines whether a user actuates a lever or other type of input control configured to control ice dispensing. In some implementations, the controller 190 may control dispensing of a set quantity of ice in response to the user setting the quantity without requiring separate input from an ice dispensing control.

If the controller 190 detects an input signal configured to control discharge of ice, the controller 190 drives the driving mechanism 132 to cause the regulator 134 to transfer ice, thereby causing dispensing of ice (S3). For example, the controller 190 controls a motor to turn the regulator to transfer ice from the case 120 to the outlet 124. If the controller 190 does not detect an input signal configured to control discharge of ice, the controller 190 waits for an input signal and may reset the desired quantity of ice based on additional input from a user.

In response to driving the regulator 134 to dispense ice, the sensor 150 senses a number of discharged ice pieces passing through the outlet 124 (S4). For example, the sensor 150 detects an ice piece passing through the outlet 124 based on the signals produced by receivers 155. In this example, the controller 190 may receive signals from the receivers 155 and track the number of ice pieces dispensed based on the signals.

The controller 190 controls discharge of ice by actuating (or continuing to actuate) the driving mechanism until the number of discharged ice pieces sensed by the sensor 150 becomes equal to the number of ice pieces input by the user (S5). For example, the controller 190 may compare a tracked number of ice pieces dispensed to the desired quantity set by the user each time another ice piece is detected as being dispensed.

If the number of discharged ice pieces sensed by the sensor 150 is equal to the number of desired ice pieces input by the user, the controller 190 stops actuation of the driving mechanism (S6). For example, the controller 190 sends a signal turning off the driving mechanism in response to detecting that the desired quantity of ice has been dispensed. Turning off the driving mechanism may stop dispensing of ice. In implementations in which a user enters a quantity of ice other than a number of ice pieces to discharge, the controller 190 may correlate the entered quantity to an estimated number of ice pieces and control dispensing based on the estimated number of ice pieces to dispense the quantity of ice desired by the user.

In some implementations, even when the number of discharged ice pieces measured does not reach the number of ices input by the user, the controller 190 may be configured to stop dispensing of ice in response to detecting that a signal configured to control discharge of ice is not generated by the user (e.g., when the user stops actuation of the lever discharge of ice may be stopped regardless of the number of ice pieces that have been discharged).

Figure 7:
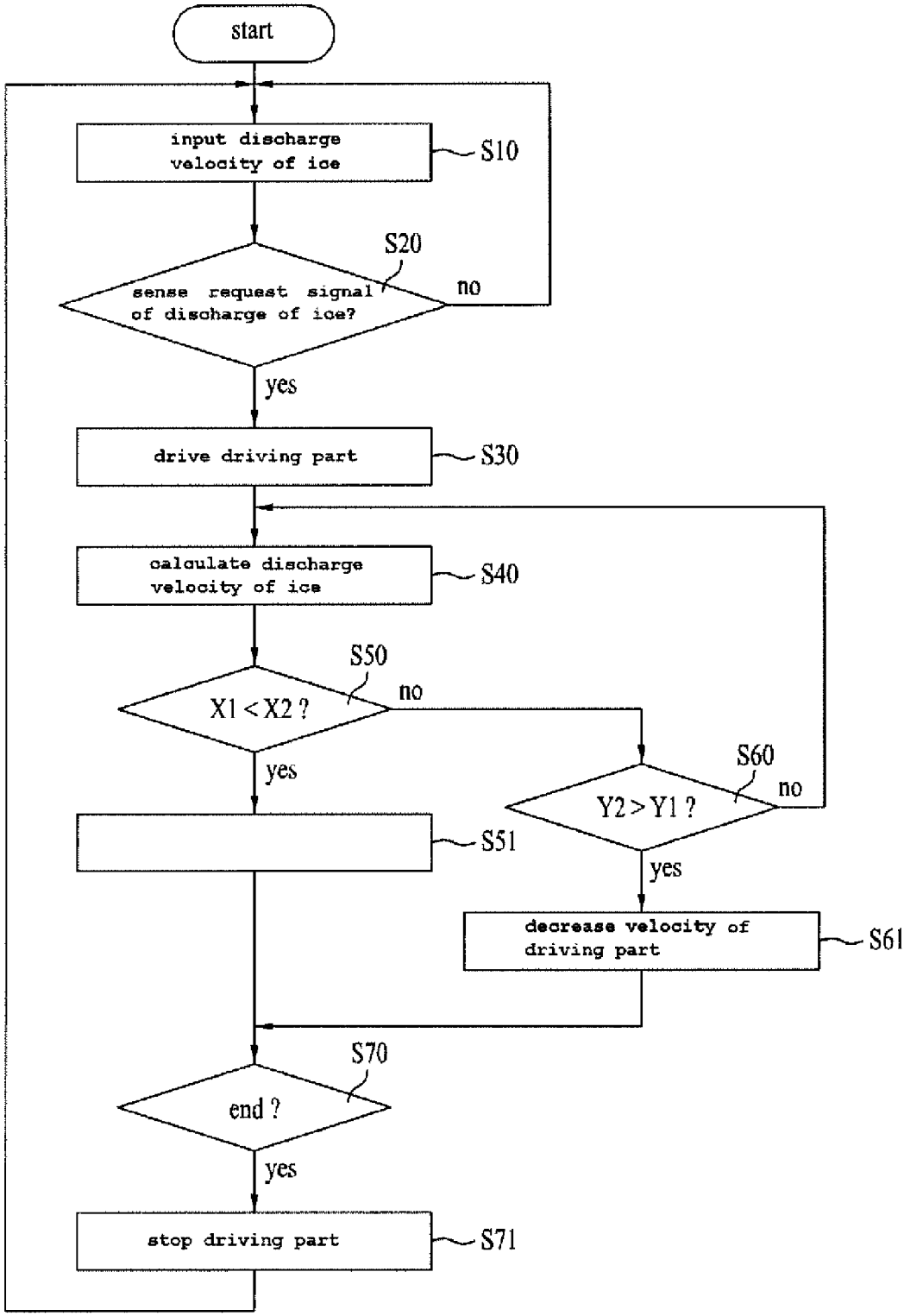
FIG. 7 is a flow chart illustrating an example of a process for controlling a velocity of supplied ice.

FIG. 7 illustrates an example of a process for controlling a velocity of supplied ice. For convenience, particular components described with respect to FIGS. 1-5 are referenced as performing the process. However, similar methodologies may be applied in other implementations where different components are used to define the structure of the system, or where the functionality is distributed differently among the components shown by FIGS. 1-5.

The input device 192 receives user input indicating a desired velocity with which to dispense ice (S10). For example, the input device 192 may receive user input indicating a particular speed or velocity with which to discharge ice or a general setting of a desired speed (e.g., Fast, Medium, Slow, etc.). The input device 192 may transmit the desired velocity input by the user to the controller 190. The controller 190 may establish the inputted desired velocity as a set velocity and control dispensing based on the set velocity.

The controller 190 determines whether an input signal configured to control discharge of ice has been received (S20). For example, the controller 190 determines whether a user actuates a lever or other type of input control configured to control ice dispensing.

If the controller 190 detects an input signal configured to control discharge of ice, the controller 190 drives the driving mechanism 132 to cause the regulator 134 to transfer ice, thereby causing dispensing of ice (S30). For example, the controller 190 controls a motor to turn the regulator to transfer ice from the case 120 to the outlet 124. If the controller 190 does not detect an input signal configured to control discharge of ice, the controller 190 waits for an input signal and may reset the desired velocity based on additional input from a user.

In response to driving the regulator 134 to dispense ice, the sensor 150 senses ice pieces passing through the outlet 124 and the controller calculates the discharge velocity of the sensed ice pieces (S40). For example, the controller 190 may keep track of a number of ice pieces sensed by the sensor 150 for a given period of time and determine the velocity of ice discharge by dividing the number of pieces by the given period of time.

The controller 190 controls discharge of ice at the discharge velocity input by the user by controlling the velocity of rotation speed of the driving mechanism until the calculated discharge velocity of ice equals the discharge velocity of ice input by the user.

The controller 190 determines whether the calculated discharge velocity of ice is less than the discharge velocity of ice input by the user (S50). If the calculated discharge velocity of ice is less than the discharge velocity of ice input by the user, the controller 190 increases the velocity of the driving mechanism to increase the discharge velocity of ice (S51).

If the calculated discharge velocity of ice is not less than the discharge velocity of ice input by the user, the controller 190 determines whether the calculated discharge velocity of ice is greater than the discharge velocity of ice input by the user (S60).

If the calculated discharge velocity of ice is greater than the discharge velocity of ice input by the user, the controller 190 decreases the velocity of the driving mechanism to decrease the discharge velocity of ice (S61).

The steps S50 and S51 and the steps S60 and S61 are repeated until the calculated discharge velocity of ice approximates or equals the discharge velocity of ice input by the user.

In some implementations, the controller 190 may directly compare the calculated discharge velocity of ice with the discharge velocity of ice input by the user and control the driving mechanism based on the comparison.

If an input signal configured to control dispensing of ice is not sensed or if a separate end signal is generated (S70), the controller 190 stops actuation of the driving mechanism to stop dispensing of ice (S71). Ice dispensing may be stopped even if a desired velocity of ice discharge has not been achieved.

Figure 8A:
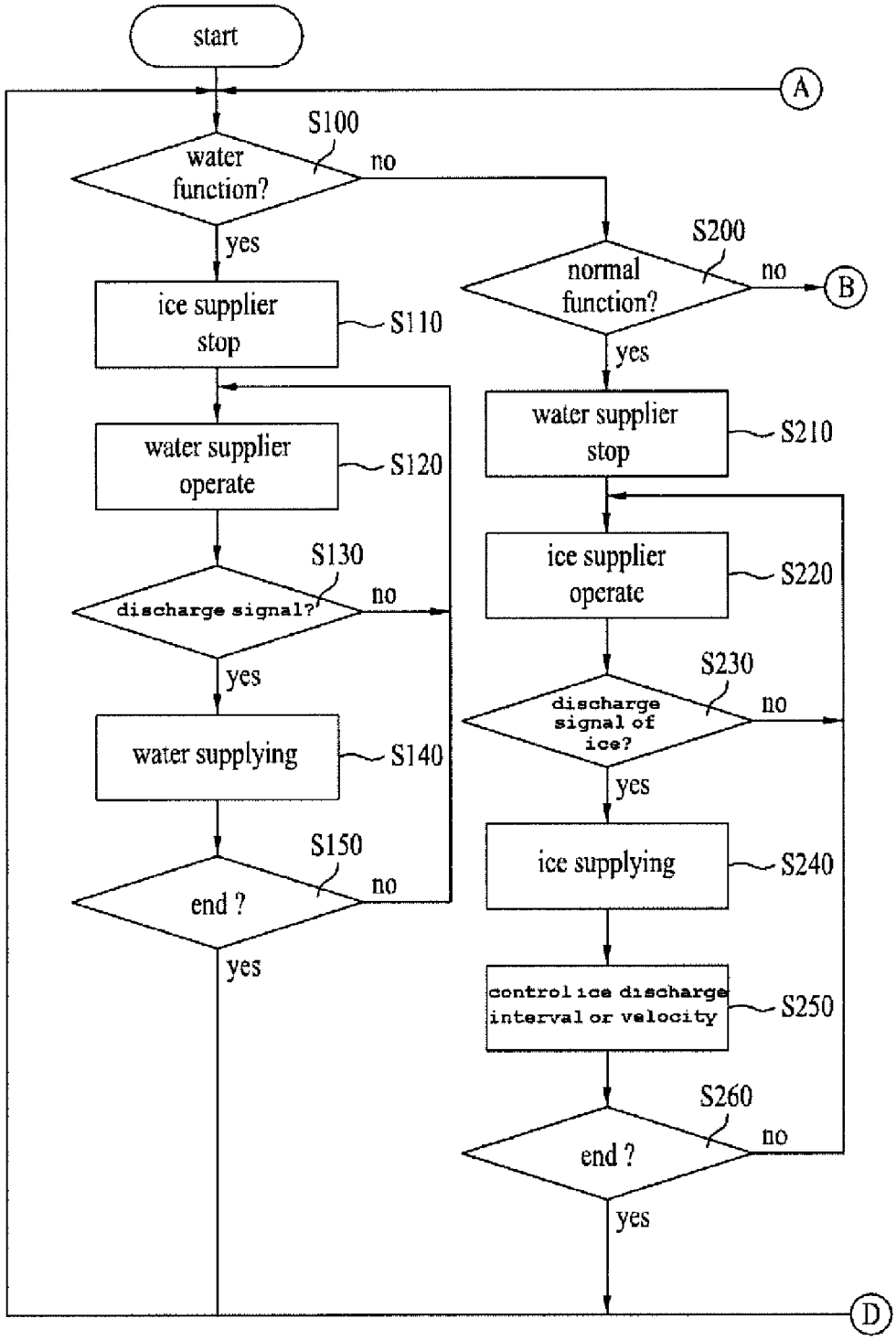
FIGS. 8A-8C show a flow chart illustrating an example of a process for controlling a quantity and a velocity of ice supplied by an ice supplier.
Figure 8B:
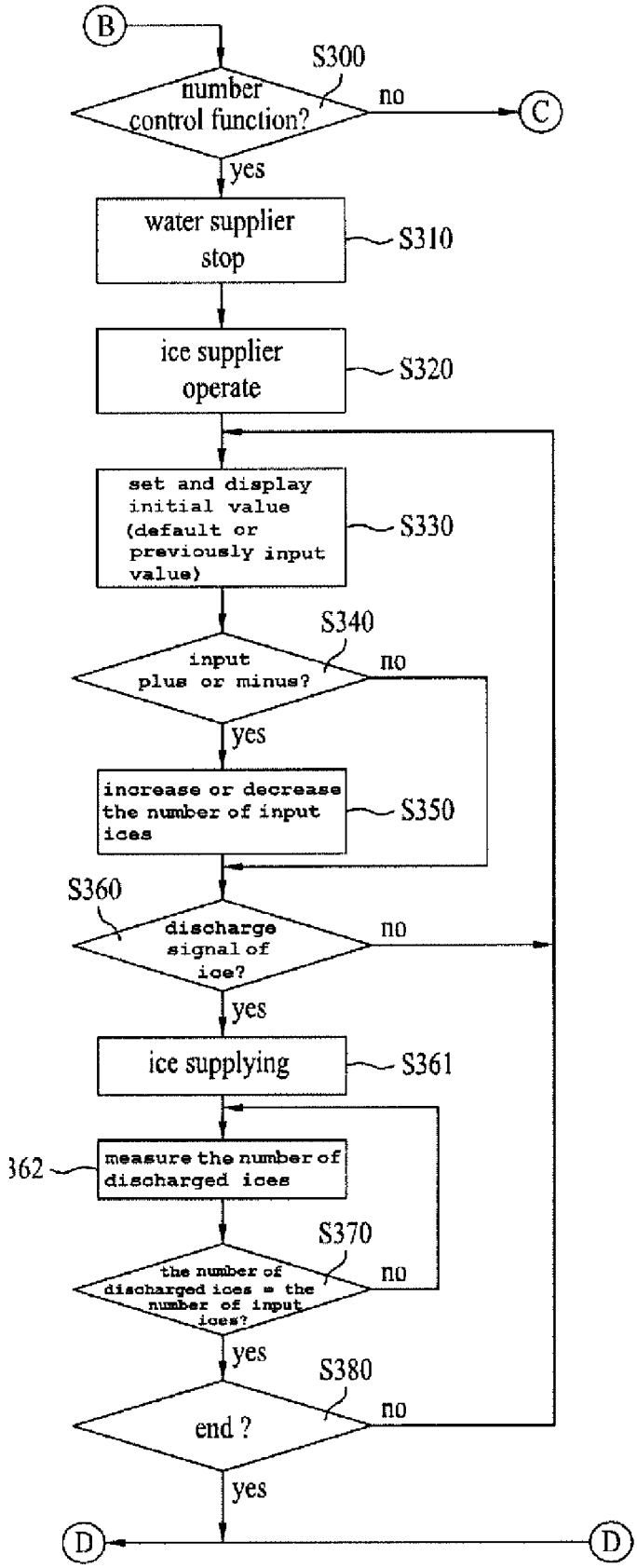
Figure 8C:
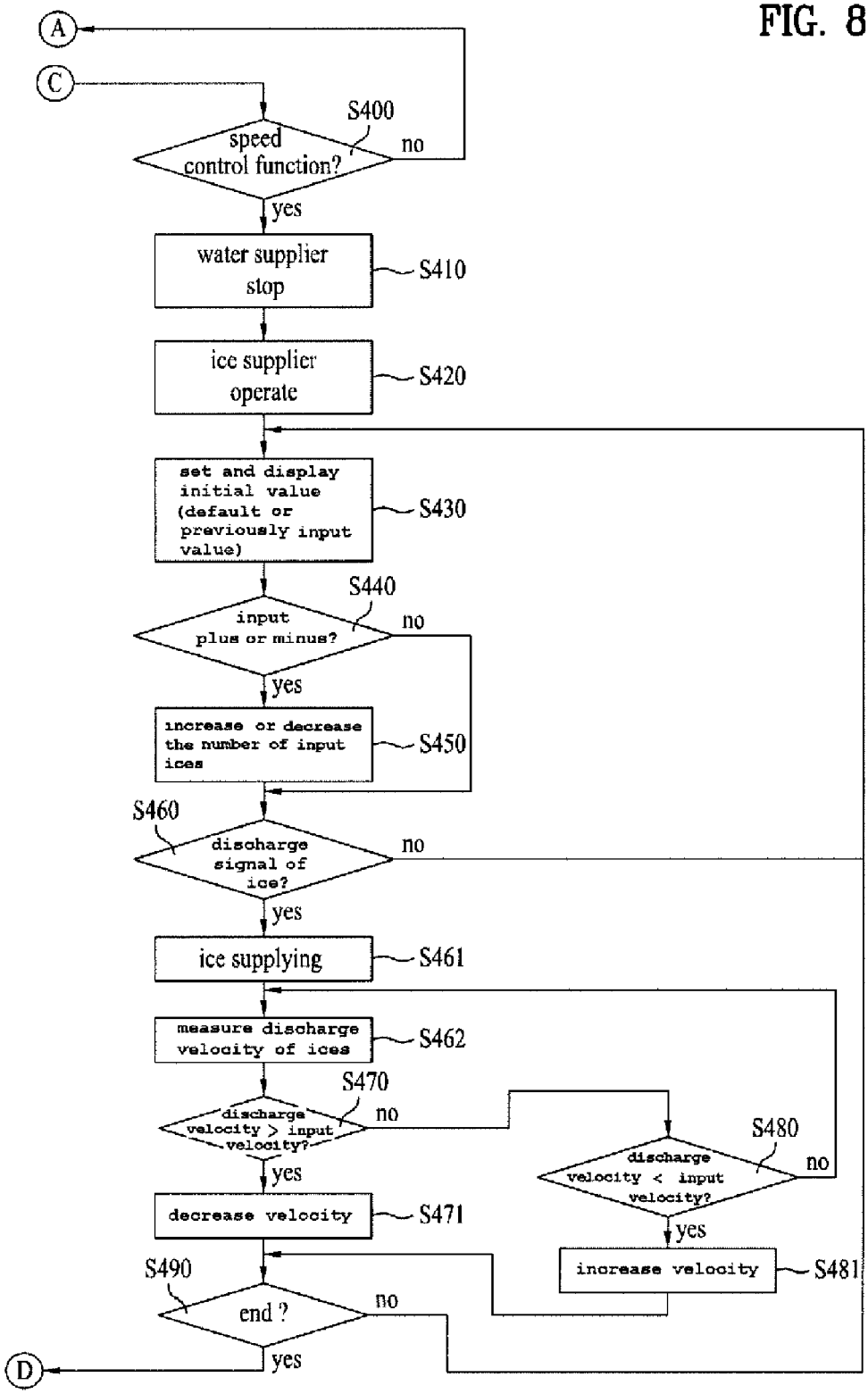

FIGS. 8A-8C illustrate an example of a process for controlling a quantity and a velocity of ice supplied by an ice supplier. For convenience, particular components described with respect to FIGS. 1-5 are referenced as performing the process. However, similar methodologies may be applied in other implementations where different components are used to define the structure of the system, or where the functionality is distributed differently among the components shown by FIGS. 1-5. The controller 190 determines whether a water function has been selected (S100). For example, the controller 190 determines whether a user has selected the water function using the input device 192. If the user has selected the water function (S100), the controller 190 stops the ice supplier (S110) and actuates the water supplier (S120).

When the water supplier is activated, the controller 190 senses whether a discharge signal exists (S130) (for example, the controller 190 determines whether the user actuates a lever configured to control dispensing).

If the discharge signal exists, the controller 190 causes water to be supplied to the user (S140). If the user releases actuation of the lever, supply of water is stopped.

The controller 190 determines whether the water function ends (S150). If the water function ends, the controller 190 feeds back to selection of a function (e.g., steps S100 to S400).

The controller 190 determines whether a normal ice function has been selected (S200). For example, the controller 190 determines whether a user has selected the normal ice function using the input device 192. If the user has selected the normal ice function (S200), the controller 190 stops the water supplier (S210) and actuates the ice supplier (S220).

The controller 190 determines whether a discharge signal of ice exists (S230). If the discharge signal of ice exists, the controller 190 supplies ice to the user (S240). In this mode of operation, the discharge velocity of ice may be controlled by the process disclosed with respect to FIG. 6 and FIG. 7.

The controller 190 determines whether the normal ice function ends (S260). If the normal ice function ends, the controller 190 feeds back to selection of a function (e.g., steps S100 to S400).

The controller 190 determines whether a number control ice function has been selected (S300). For example, the controller 190 determines whether a user has selected the number control ice function using the input device 192. If the user has selected the number control ice function (S300), the controller 190 stops the water supplier (S310) and actuates the ice supplier (S320).

The controller 190 sets an initial value (S330). For example, the controller 190 may set the initial value as a number of ice pieces input to the controller 190 as a default number or may set the initial value as a number of ice pieces previously input to the controller 190. The initial value may be displayed in the display device.

The controller 190 determines whether a user has provided user input to increase or decrease the initial value of the number of ice pieces (S340). If a discharge signal of ice is generated (e.g., if the user actuates a lever configured to control dispensing) and input has not been provided, ice equivalent to the number of ice pieces displayed in the display device (e.g., the initial value) is discharged.

The user may modify the initial value. If the user pushes a plus button (e.g., as shown in FIG. 3) to increase the number of ice pieces (S340), the number of ice pieces displayed in the display device increases and the controller 190 sets the value for the number of ice pieces to the input number of ice pieces (S350).

If the user pushes a minus button (e.g., as shown in FIG. 3) to decrease the number of ice pieces (S340), the number of ice pieces displayed in the display device decreases and the controller 190 sets the value for the number of ice pieces to the input number of ice pieces (S350).

The controller 190 determines whether a discharge signal for ice is generated (S360). If the discharge signal of ice is generated (e.g., if the user actuates a lever configured to control ice dispensing), the controller 190 turns on the driving mechanism to cause ice to be supplied (S361). In response to initiating supply of ice, the number of ice pieces discharged through the outlet 124 is measured by the sensor 150 and the controller 190 (S362). By measuring the number of ice pieces discharged, ice equivalent to the input number of ice pieces may be discharged. The number of ice pieces displayed in the display device may be decreased as ice is discharged. In other implementations, a second number of ice pieces may be provided to display the number of ice pieces that have been sensed as being discharged.

The controller 190 determines whether the number of discharged ice pieces sensed by the sensor 150 is equal to the number of ices input by the user (S370). If the number of discharged ice pieces sensed by the sensor 150 is equal to the number of ice pieces input by the user, the controller 190 stops actuation of the driving mechanism to stop discharge of ice. If the number of discharged ice pieces sensed by the sensor 150 is less than the number of ice pieces input by the user, the controller continues to discharge ice.

If the discharge signal of ice ends while the set quantity of ice pieces is being discharged, the controller 190 may stop discharge of ice. In some implementations, if the discharge signal of ice is generated again, the controller 190 may allow the remaining quantity of ice pieces to be discharged.

The controller 190 determines whether the number control ice function ends (S380). If the number control ice function ends, the controller feeds back to selection of a function (e.g., steps S100 to S400).

The controller 190 determines whether a speed control ice function has been selected (S400). For example, the controller 190 determines whether a user has selected the speed control ice function using the input device 192. If the user selects the speed control ice function (S400), the controller 190 stops the water supplier (S410) and actuates the ice supplier (S420).

The controller 190 sets an initial value (S430). For example, the controller 190 may set the initial value as the velocity of ice discharge input to the controller as a default or the velocity of ice discharge previously input to the controller 190. The initial value may be displayed in the display device.

The controller 190 determines whether a user has provided user input to increase or decrease the initial value of the velocity of ice discharge (S440). If a discharge signal of ice is generated (e.g., if the user actuates a lever configured to control ice dispensing) without receiving additional input from the user, ice may be discharged at the initial value of the velocity displayed in the display device.

The user may modify the initial value. If the user pushes a plus button (e.g., as shown in FIG. 3) to increase the velocity of ice discharge (S440), the velocity of ice displayed in the display device increases and the controller 190 sets the discharge velocity of ice to the input velocity of ice (S450).

If the user pushes a minus button (e.g., as shown in FIG. 3) to decrease the velocity of ice (S440), the velocity of ice displayed in the display device decreases and the controller 190 sets the discharge velocity of ice to the input velocity of ice (S450).

If the discharge signal of ice is generated (S460), (e.g., if the user actuates a lever configured to control ice dispensing), ice is discharged (S461).

The sensor 150 senses a number of discharged ice pieces or a discharge time of ice pieces, and the controller 190 calculates the discharge velocity of ice based on the sensed result (S462) and controls the velocity of the driving mechanism based on the sensed result. In one example, the velocity of ice discharged may be measured by counting a number of ice pieces for a given period time and dividing the number counted by the period of time.

The controller 190 determines whether the calculated discharge velocity of ice is greater than the input discharge velocity of ice (S470). If the calculated discharge velocity of ice is greater than the input discharge velocity of ice, the controller decreases the velocity of the driving mechanism (S471). If the calculated discharge velocity of ice is not greater than the input discharge velocity of ice, the controller 190 determines whether the calculated discharge velocity of ice is less than the input discharge velocity of ice (S480). If the calculated discharge velocity of ice is less than the input discharge velocity of ice, the controller 190 increases the velocity of the driving mechanism to increase the discharge velocity of ice (S481).

The controller determines whether the speed control function ends (S490). If the speed control function ends, the controller feeds back to selection of a function (e.g., steps S100 to S400).

Figure 9:
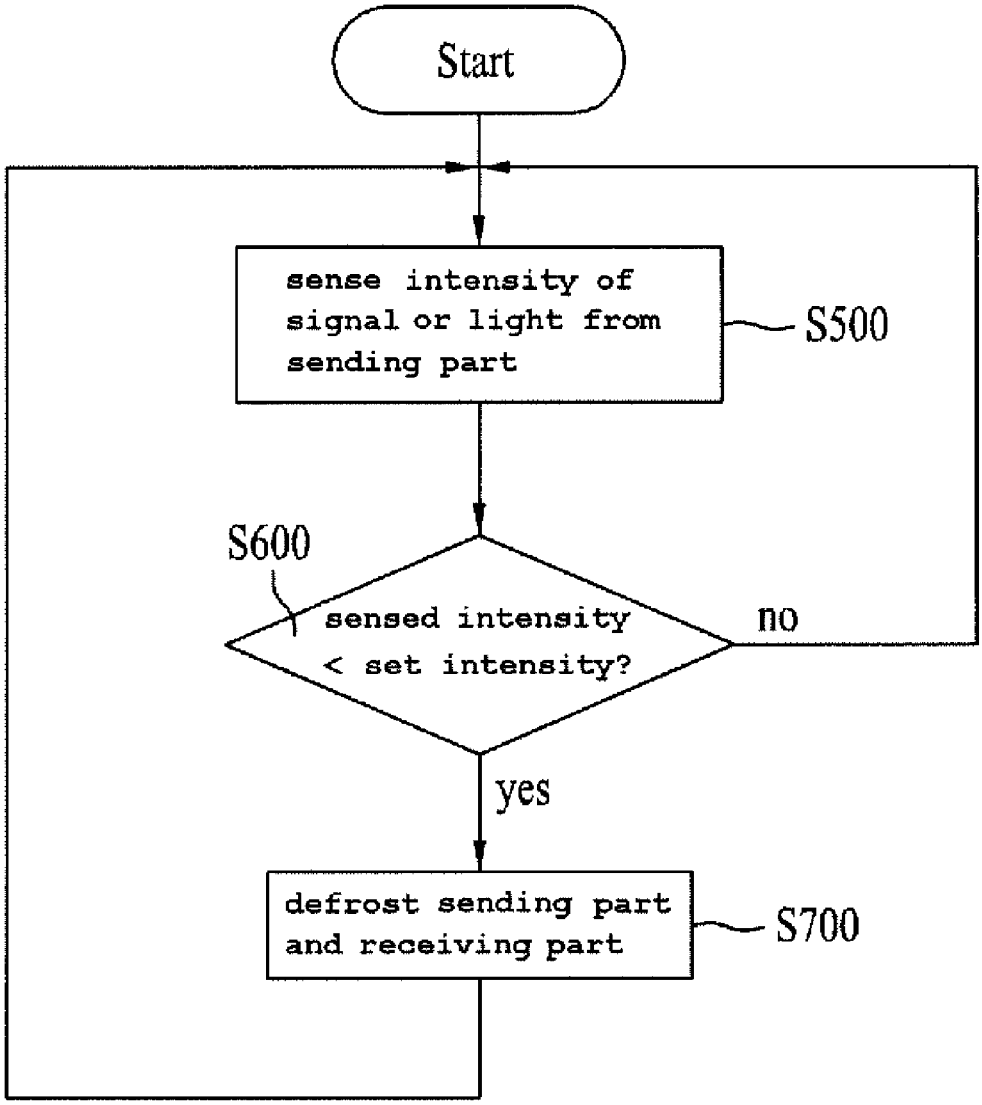
FIG. 9 is a flow chart illustrating an example of a process of defrosting sensing elements of an ice supplier.

FIG. 9 is illustrates an example of a process of defrosting of sensing elements of an ice supplier. As shown in FIG. 9, each detector of the receiving part detects the intensity of the signal or light sent from the sending part (S500).

The controller 190 controls the heating member to defrost the sensor 150 (S700) if the detected intensity of the signal or light is less than a preset or known intensity (S600).

Actuation of the ice supplier may be stopped while the sensor is defrosted.

In some implementations, the ice supplier may continue to be actuated while the sensor is defrosted. In these implementations, because the quantity of discharged ice pieces or their velocity cannot be sensed, ice is discharged in a state in which the quantity and discharge velocity of ice is not controlled.

In some examples, a user can discharge ice of a constant quantity regardless of a time that the user pushes a button or a lever configured to control ice dispensing. In these examples, the user does not have to control the pushing time of the button or the lever to discharge ice of appropriate quantity. This may improve the user's convenience.

In some implementations, because the discharge velocity of ice may be maintained uniformly, ice may be prevented from being abruptly discharged or from being slowly discharged. This may result in enabling a user to easily control the quantity of ice.

In some examples, because the user may directly input the desired quantity of ice or the desired discharge velocity of ice to a controller depending on the user's desire, the user's convenience may be improved.

In some examples, because the sensor 150 may be defrosted, the sensitivity of the sensor 150 may be improved.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. An appliance comprising:

a dispenser including an ice dispensing chute;

an ice storage bin configured to store ice pieces, the ice storage bin including an opening configured to communicate with the ice dispensing chute, and an ice flow path extending at least partially from the ice storage bin to an outlet of the dispenser;

a transfer mechanism configured to transfer ice pieces from the ice storage bin along the ice flow path;

an input device configured to receive user input indicating a desired discharge volume of ice per unit time, wherein the user input indicating the desired discharge volume of ice per unit time is a selection of one of a slow volume of ice per unit time and a fast volume of ice per unit time;

a sensor configured to sense ice pieces passing along the ice flow path; and a controller configured to:

determine a volume of ice per unit time passing along the ice flow path based on input from the sensor, and control the transfer mechanism based on the determined volume of ice per unit time.

2. The appliance as claimed in claim 1, wherein the sensor comprises:

a sender positioned at a side of the opening and configured to send a signal; and a receiver positioned at a side of the opening opposite the sender and configured to receive the signal sent from the sender enabling ice pieces passing along the ice flow path to be sensed.

3. The appliance as claimed in claim 2, wherein the signal is an Infrared light signal that is at least partially occluded by ice pieces passing along the ice flow path.

4. The appliance as claimed in claim 1, wherein the transfer mechanism comprises:

a regulator configured to transfer the ice pieces in the ice storage bin to the opening and along the ice flow path; and a driving mechanism configured to drive the regulator based on a signal received from the controller.

5. The appliance as claimed in claim 4, wherein the controller is configured to control velocity of the driving mechanism based on the determined volume of ice per unit time.

6. The appliance as claimed in claim 4, wherein the controller is configured to calculate the volume of ice per unit time of ice pieces passing along the ice flow path based on a number of sensed ice pieces per unit time, and control the driving mechanism based on the number of sensed ice pieces per unit time.

7. The appliance as claimed in claim 1, further comprising a display device configured to render a user interface showing a volume of ice per unit time based on the determined volume of ice per unit time passing along the ice flow path.

8. An appliance comprising:

a dispenser including an ice dispensing chute;

an ice storage bin configured to store ice pieces, the ice storage bin including an opening configured to communicate with the ice dispensing chute, and an ice flow path extending at least partially from the ice storage bin to an outlet of the dispenser;

a transfer mechanism configured to transfer ice pieces from the ice storage bin along the ice flow path;

an input device configured to receive user input indicating a desired discharge volume of ice per unit time;

a sensor configured to sense ice pieces passing along the ice flow path; and a controller configured to:

determine a volume of ice per unit time passing along the ice flow path based on input from the sensor, compare the determined volume of ice per unit time to the desired volume of ice per unit time, increase a transfer speed of the transfer mechanism conditioned on the determined volume of ice per unit time being less than the desired discharge volume of ice per unit time, decrease a transfer speed of the transfer mechanism conditioned on the determined volume of ice per unit time being greater than the desired discharge volume of ice per unit time, and control a transfer speed of the transfer mechanism to adjust the volume of ice per unit time passing along the ice flow path such that a difference between the determined volume of ice per unit time and the desired discharge volume of ice per unit time is less than a threshold amount.

9. The appliance as claimed in claim 8, wherein the user input indicating the desired discharge volume of ice per unit time is a number of ice pieces per unit time.

10. An appliance comprising:

an ice maker configured to make ice pieces;

an ice storage bin configured to store ice pieces made by the ice maker;

a dispenser configured to dispense ice pieces stored by the ice storage bin through an outlet;

an ice dispensing chute that extends at least partially between the ice storage bin and the outlet of the dispenser and that defines at least a portion of an ice flow path for ice pieces being dispensed by the dispenser;

a transfer mechanism configured to transfer ice pieces stored by the ice storage bin along the ice flow path;

an input device configured to receive user input indicating a desired discharge volume of ice per unit time of ice pieces;

at least one sensor configured to sense ice pieces passing along the ice flow path; and at least one controller configured to:

determine a volume of ice per unit time of ice pieces passing along the ice flow path based on input from the at least one sensor, and control the transfer mechanism to cause a difference between the determined volume of ice per unit time of ice pieces passing along the ice flow path and the desired discharge volume of ice per unit time to be within a threshold amount.

11. The appliance as claimed in claim 10, wherein the at least one controller is further configured to compare the determined volume of ice per unit time of ice pieces passing along the ice flow path to the desired discharge volume of ice per unit time.

12. The appliance as claimed in claim 11, wherein the at least one controller is further configured to increase a transfer speed of the transfer mechanism conditioned on the determined volume of ice per unit time of ice pieces passing along the ice flow path being less than the desired discharge volume of ice per unit time.

13. The appliance as claimed in claim 11, wherein the at least one controller is further configured to decrease a transfer speed of the transfer mechanism conditioned on the determined volume of ice per unit time of ice pieces passing along the ice flow path being greater than the desired discharge volume of ice per unit time.

14. The appliance as claimed in claim 10, wherein the at least one controller is configured to control the transfer mechanism to cause the difference between the determined volume of ice per unit time of ice pieces passing along the ice flow path and the desired discharge volume of ice per unit time to be within the threshold amount by:

comparing the determined volume of ice per unit time of ice pieces passing along the ice flow path to the desired discharge volume of ice per unit time;

determining whether the difference between the determined volume of ice per unit time of ice pieces passing along the ice flow path and the desired discharge volume of ice per unit time is within the threshold amount based on the comparison; and controlling the transfer mechanism based on the determination of whether the difference between the determined volume of ice per unit time of ice pieces passing along the ice flow path and the desired discharge volume of ice per unit time is within the threshold amount.

15. The appliance as claimed in claim 14, wherein controlling the transfer mechanism based on the determination of whether the difference between the determined volume of ice per unit time of ice pieces passing along the ice flow path and the desired discharge volume of ice per unit time is within the threshold amount comprises:

maintaining a transfer speed of the transfer mechanism in response to a determination that the difference between the determined volume of ice per unit time of ice pieces passing along the ice flow path and the desired discharge volume of ice per unit time is within the threshold amount; and adjusting a transfer speed of the transfer mechanism in response to a determination that the difference between the determined volume of ice per unit time of ice pieces passing along the ice flow path and the desired discharge volume of ice per unit time is outside of the threshold amount.

16. The appliance as claimed in claim 15, wherein adjusting the transfer speed of the transfer mechanism comprises:

determining whether the determined volume of ice per unit time of ice pieces passing along the ice flow path is greater than or less than the desired discharge volume of ice per unit time;

increasing a transfer speed of the transfer mechanism in response to a determination that the determined volume of ice per unit time of ice pieces passing along the ice flow path is less than the desired discharge volume of ice per unit time; and decreasing a transfer speed of the transfer mechanism in response to a determination that the determined volume of ice per unit time of ice pieces passing along the ice flow path is greater than the desired discharge volume of ice per unit time.

17. The appliance as claimed in claim 10, wherein the user input indicating the desired discharge volume of ice per unit time of ice pieces is a number of ice pieces per unit time.

18. The appliance as claimed in claim 10, wherein the user input indicating the desired discharge volume of ice per unit time of ice pieces is a selection of one of multiple possible discharge volumes of ice per unit time.

19. The appliance as claimed in claim 18, wherein the selection of one of multiple possible discharge volumes of ice per unit time is a selection of one of a relatively slow discharge volume of ice per unit time and a relatively fast discharge volume of ice per unit time.

20. The appliance as claimed in claim 10, further comprising a display device configured display a discharge volume of ice per unit time based on the determined volume of ice per unit time of ice pieces passing along the ice flow path.

21. The appliance as claimed in claim 10, wherein the at least one sensor comprises:

a sender positioned at a side of the ice dispensing chute and configured to send a signal; and a receiver positioned at a side of the ice dispensing chute opposite the sender and configured to receive the signal sent from the sender enabling ice pieces passing along the ice flow path to be sensed.

22. The appliance as claimed in claim 21, wherein the signal is an Infrared light signal that is at least partially occluded by ice pieces passing along the ice flow path.

23. The appliance as claimed in claim 10, wherein the transfer mechanism comprises:

a regulator configured to transfer the ice pieces in the ice storage bin to the ice dispensing chute and along the ice flow path; and a driving mechanism configured to drive the regulator based on a signal received from the controller.

24. The appliance as claimed in claim 23, wherein the controller is configured to control a speed of the driving mechanism based on the determined volume of ice per unit time of ice pieces passing along the ice flow path.

25. The appliance as claimed in claim 23, wherein the controller is configured to calculate the volume of ice per unit time of ice pieces passing along the ice flow path based on a number of sensed ice pieces per unit time, and control the driving mechanism based on the number of sensed ice pieces per unit time.

* * * * *